United States Patent [19]

Liebhold

[11] Patent Number: 4,494,796

[45] Date of Patent: Jan. 22, 1985

[54] BUTTERFLY CHAIR CONSTRUCTION

[76] Inventor: Martin R. Liebhold, 12404 Rochedale La., Los Angeles, Calif. 90049

[21] Appl. No.: 359,812

[22] Filed: Mar. 19, 1982

[51] Int. Cl.[3] ..... A47C 4/02

[52] U.S. Cl. ..... 297/440; 211/182

[58] Field of Search ..... 297/441, 440; 211/182; 403/207, 217, 173, 174, 170, 400, 346; 248/158; 46/29

[56] References Cited

U.S. PATENT DOCUMENTS

| | | | |
|---|---|---|---|
| 2,689,602 | 9/1954 | Morgan . | |
| 2,691,410 | 10/1954 | Boucher . | |
| 2,712,349 | 7/1955 | Le Voir . | |
| 3,195,954 | 7/1965 | Moreno | 297/441 |
| 3,708,204 | 1/1973 | Wachamann | 297/440 |
| 3,792,882 | 2/1974 | Varichon | 403/217 |
| 3,838,883 | 10/1974 | Machen | 297/45 |
| 4,047,752 | 9/1977 | Rohr | 297/441 X |
| 4,081,868 | 4/1978 | Hull | 297/422 |
| 4,251,106 | 2/1981 | Gilbert | 297/18 |
| 4,270,799 | 6/1981 | Flaum | 297/440 |
| 4,421,356 | 12/1983 | Singer | 297/441 X |

FOREIGN PATENT DOCUMENTS

| | | | |
|---|---|---|---|
| St. 7619 | 8/1956 | Fed. Rep. of Germany | 297/441 |
| 793017 | 11/1935 | France | 211/182 |
| 1184910 | 2/1959 | France | 211/182 |
| 1218839 | 5/1960 | France | 211/182 |
| 545995 | 7/1956 | Italy | 46/29 |
| 9843 | 8/1885 | United Kingdom | 297/440 |
| 1288461 | 9/1972 | United Kingdom . | |

*Primary Examiner*—James T. McCall

*Attorney, Agent, or Firm*—William W. Haefliger

[57] ABSTRACT

A butterfly chair construction, adapting the chair for packaging in a small container, and for rapid assembly by the user, includes:

(a) a framework that includes (i) multiple generally V-shaped upper members, each having two legs, (ii) multiple generally V-shaped lower members, each having two legs (iii) multiple cross pieces each having multiple arms, (b) the two legs of each upper member sized to interfit, respectively, two arms of two different cross pieces, and (c) the two legs of each lower member sized to interfit, respectively, two arms of two different cross pieces.

10 Claims, 4 Drawing Figures

FIG. 1.
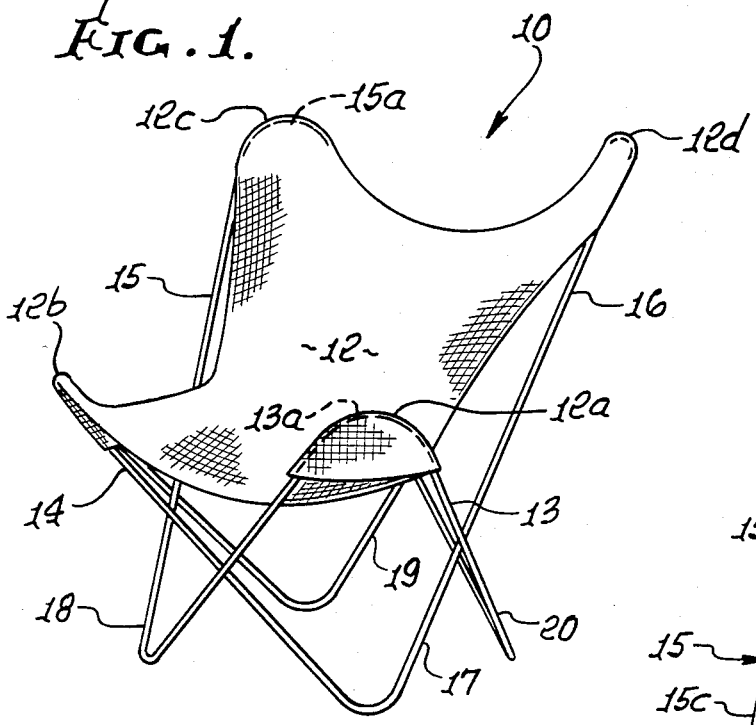
FIG. 2.
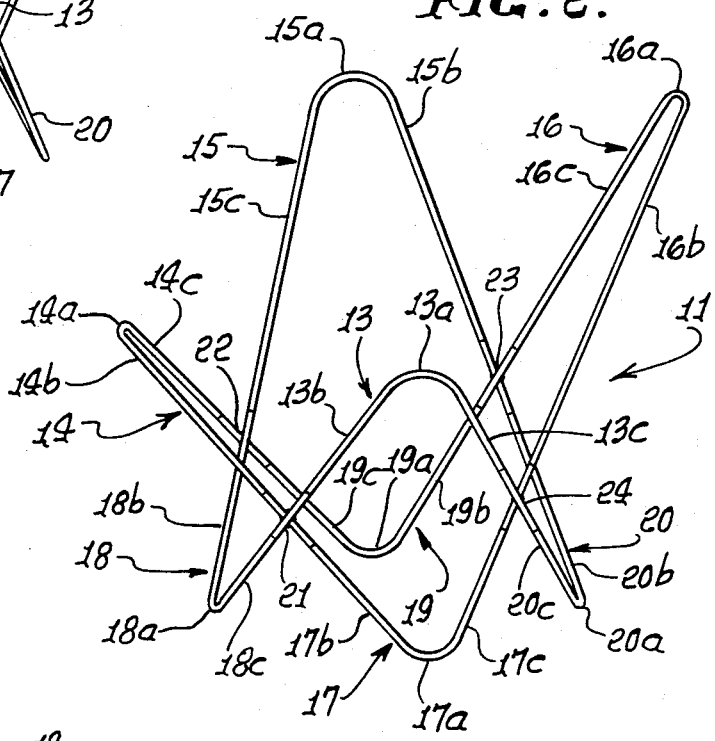
FIG. 3.
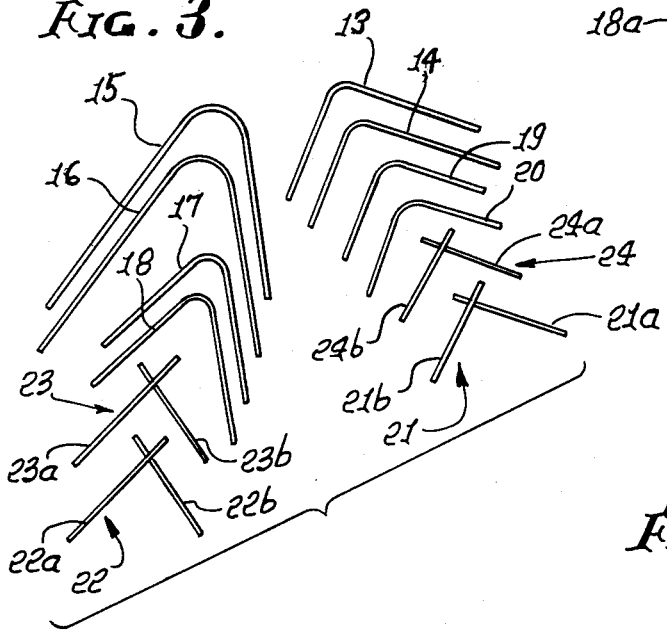
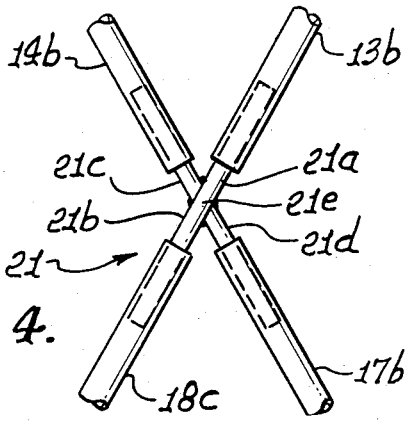
FIG. 4.

BUTTERFLY CHAIR CONSTRUCTION

BACKGROUND OF THE INVENTION

This invention relates generally to a butterfly chair construction, and more particularly concerns a butterfly chair whose elements may be packaged in a relatively small container, for shipping; and such elements may be removed from the container for rapid assembly into a one-piece unit.

Butterfly chairs have been known for many years, but the problem of handling and shipping them in frame-formed condition has remained. As a result, the chairs were difficult to package, transport and store, due to their bulky and ungainly shapes and relatively large size.

SUMMARY OF THE INVENTION

It is a major object of the invention to provide butterfly chair components of such design and construction as will enable extremely easy shipment and handling.

Basically, the improved chair construction comprises:

(a) a framework that includes
  (i) multiple generally V-shaped upper members, each having two legs,
  (ii) multiple generally V-shaped lower members, each having two legs,
  (iii) multiple connections to hold two pairs of leg members in connected relation at each of multiple locations, each interconnected pair including an upper and lower leg member, (b) whereby when all of the connections are effected at said multiple locations, the framework is a one-piece unit.

As will further appear, the multiple connections may with unusual advantage comprise multiple cross-pieces each having multiple arms; the two legs of each upper member sized to interfit, respectively, the arms of two different cross-pieces; and the two legs of each lower member sized to interfit, respectively, the two arms of two different cross pieces.

A further object is to provide for telescopic interfit of the legs and arms in such manner that four arms of one cross piece interfit one leg each of four different upper and lower V-shaped members, as will be seen, the seating loading tending to enhance the telescopic interfit of these elements.

These and other objects and advantages of the invention, as well as the details of an illustrative embodiment, will be more fully understood from the following specification and drawings, in which:

DRAWING DESCRIPTION

FIG. 1 is a perspective view of an assembled butterfly type chair incorporating the invention;

FIG. 2 is a perspective view of the frame of the FIG. 1 chair;

FIG. 3 is a plan view of frame members and cross pieces, in pre-assembled condition; and FIG. 4 is an enlarged view showing frame members assembled to a cross piece.

DETAILED DESCRIPTION

The chair 10 in FIG. 1 includes a metallic framework 11 supporting a seat and backrest 12 made of flexible material, as for example canvas. The seat includes corner portions 12*a*–12*d* conventionally slung over the curved or rounded apices of multiple, generally V-shaped upper frame members as at 13–16. Such curved apices are better shown at 13*a*–16*a* in FIGS. 2 and 3. Each upper frame member also has two legs, and these elements are tabulated as follows:

| upper member | legs | apices |
|---|---|---|
| 13 | 13b, 13c | 13a |
| 14 | 14b, 14c | 14a |
| 15 | 15b, 15c | 15a |
| 16 | 16b, 16c | 16a |

The framework also includes multiple generally V-shaped lower frame member as at 17–20 respectively having curved apices 17*a*–20*a*, as better shown in FIGS. 2 and 3. Each lower frame member also has two legs, and these elements are tabulated as follows:

| Lower member | legs | apices |
|---|---|---|
| 17 | 17b, 17c | 17a |
| 18 | 18b, 18c | 18a |
| 19 | 19b, 19c | 19a |
| 20 | 20b, 20c | 20a |

In accordance with a further aspect of the invention, connections are provided to interconnect the legs of the upper and lower members, so that the interconnected legs have linear continuity, with necessary strength to support the seated user. Further, each interconnected leg pair crosses at an angle another interconnected leg pair, and connections are provided to interconnected the crossing pairs.

In the example, multiple cross pieces, as at 21–24, are provided, each having multiple arms. The cross pieces and their arms are tabulated as follows:

| cross piece | arms |
|---|---|
| 21 | 21a, 21b aligned |
| | 21c, 21d aligned |
| 22 | 22a, 22b aligned |
| | 22c, 22d aligned |
| 23 | 23a, 23b aligned |
| | 23c, 23d aligned |
| 24 | 24a, 24b aligned |
| | 24c, 24d aligned |

In particular, the arms of the cross pieces may have frictional telescopic interfit with the legs of the V-shaped members; and the cross piece arms may comprise metal rods, whereas the legs may comprise metal tubes to closely receive the rods. See for example, in FIG. 4, the cross piece 21 having arm 21*a* interfitting upper leg 13*b*, arm 21*b* interfitting lower leg 18*c*, arm 21*c* interfitting upper leg 14*c*, and arm 21*d* interfitting lower leg 17*b*. The two arms 21*a* and 21*b* may comprise one metal rod, and the two arms 21*c* and 21*d* may comprise one metal rod, the two rods welded together at their cross-over location, i.e. at 21*e*. Alternatively, two arms 21*a* and 21*b* may be butt welded to one rod that defines arms 21*c* and 21*d*, for example. Accordingly, an extremely strong interconnection of two leg pairs is effected at one location, simply by the user assembling these elements to the arms of the cross-piece. Also, the cross piece holds each leg pair in generally aligned relation; and the downward seating loading tends to enhance the connection of the legs to the cross piece, the four rods of which all have upward components. Further, the rods of each cross piece typically have axes which are non-intersecting.

From the above, it is clear that the butterfly chair construction adapts the chair for rapid assembly, and includes:

(a) a framework that includes
  (i) multiple generally V-shaped upper members, each having two legs
  (ii) multiple generally V-shaped lower members, each having two legs
  (iii) multiple connections to hold two pairs of leg members in connected relation at each of multiple locations, each interconnected pair including an upper and lower leg member
(b) whereby when all of the connections are effected at said multiple locations, the framework is a one-piece unit.

Further, as shown in FIG. 3, the legs and arms may be superimposed and packaged in a relatively small container, for shipping, and then may be quickly assembled into FIG. 2 one-piece framework. Further, the chair may be disassembled, for later shipment, if desired.

I claim:

1. In a butterfly chair construction adapting the chair for rapid assembly, the combination comprising
(a) a framework that includes
  (i) four generally V-shaped upper members, each having two legs,
  (ii) four generally V-shaped lower and substantially rigid members, each having two legs,
  (iii) four cross pieces each having two rods defining four arms, the two rods interconnected in crossed relation, the two rods having axes which are non-intersecting,
(b) the two legs of each upper member sized to slidably interfit, respectively, two arms of two different cross pieces, and
(c) the two legs of each lower member sized to slidably interfit, respectively, two arms of two different cross pieces.

2. The combination of claim 1 wherein interfitting arms and legs are sized to have telescopic interfit.

3. The combination of claim 2 wherein the legs have sleeve extents adapted to receive said arms which the legs interfit.

4. The combination of claim 3 wherein said arms have rod extents adapted for reception in said sleeve extents which the arms interfit.

5. The combination of one of claims 1–4 wherein two of said arms of each cross piece are substantially longer than the remaining two arms of the cross piece.

6. The combination of claim 5 wherein the legs and arms have frictional interfit.

7. The combination of one of claims 1–6 wherein there are four of said upper members, four of said lower members, and four of said cross pieces, each cross piece having four arms.

8. The combination of claim 7 wherein said members and cross pieces consist of metal.

9. The combination of claim 6 wherein arms defined by each cross piece are welded together.

10. In a butterfly chair construction adapting the chair for rapid assembly, the combination
(a) a framework that includes
  (i) multiple generally V-shaped upper members, each having two legs,
  (ii) multiple generally V-shaped lower members, each having two legs,
  (iii) multiple connections to hold two pairs of leg members in connected relation at each of multiple locations, each interconnected pair including an upper and lower leg member,
(b) whereby when all of the connections are effected at said multiple locations, the framework is a one-piece unit,
(c) said multiple connections including multiple cross pieces each having rods defining four arms, two of said rods interconnected in crossed relation, the rods having axes which are non-intersecting.

* * * * *